US008631828B1

(12) United States Patent
Ward

(10) Patent No.: US 8,631,828 B1
(45) Date of Patent: Jan. 21, 2014

(54) ANHYDROUS AMMONIA FLOW DIVIDING MANIFOLD

(75) Inventor: David P. Ward, Dallas, TX (US)

(73) Assignee: Continental NH3 Products Co., Inc., Dallas, TX (US)

( * ) Notice: Subject to any disclaimer, the term of this patent is extended or adjusted under 35 U.S.C. 154(b) by 101 days.

(21) Appl. No.: 13/403,837

(22) Filed: Feb. 23, 2012

(51) Int. Cl.
*B01F 5/00* (2006.01)

(52) U.S. Cl.
USPC ..... 137/896; 137/561 A

(58) Field of Classification Search
USPC ..... 137/262, 556, 561 A, 896; 239/553, 239/590.3; 111/119; 285/125.1; 366/160.1, 366/167.1, 177.1, 184, 336, 338
See application file for complete search history.

(56) References Cited

U.S. PATENT DOCUMENTS

| | | | | |
|---|---|---|---|---|
| 2,193,696 | A | 3/1940 | Ramsaur | |
| 2,650,556 | A | 9/1953 | Turner | |
| 2,781,612 | A | 2/1957 | Dugan | |
| 4,043,486 | A * | 8/1977 | Wisbey | 222/134 |
| 4,432,651 | A * | 2/1984 | McLeod | 366/336 |
| 4,448,540 | A * | 5/1984 | McLeod | 366/160.1 |
| 5,040,558 | A * | 8/1991 | Hickey et al. | 137/1 |
| 5,170,820 | A | 12/1992 | Jones | |
| 5,372,160 | A | 12/1994 | Ward | |
| 6,283,049 | B1 | 9/2001 | Swanson | |
| 6,311,716 | B1 | 11/2001 | Jones | |
| 6,484,653 | B2 | 11/2002 | Swanson | |
| 6,557,573 | B2 | 5/2003 | Nimberger | |
| 6,851,450 | B2 | 2/2005 | Nimberger | |
| 6,901,948 | B2 | 6/2005 | Nimberger | |
| 7,063,276 | B2 | 6/2006 | Newton | |
| 2001/0015161 | A1 | 8/2001 | Swanson | |
| 2002/0023576 | A1 | 2/2002 | Swanson | |
| 2002/0144735 | A1 | 10/2002 | Nimberger | |
| 2004/0025947 | A1 | 2/2004 | Nimberger | |
| 2004/0094203 | A1 | 5/2004 | Nimberger | |
| 2005/0211802 | A1 | 9/2005 | Newton | |

* cited by examiner

*Primary Examiner* — John Rivell
*Assistant Examiner* — Angelisa Hicks
(74) *Attorney, Agent, or Firm* — Mark W Handley

(57) ABSTRACT

A flow dividing manifold (12) divides a flow of anhydrous ammonia having both liquid and gas phases into separate flow paths. The manifold (12) has a first mixing nozzle (32) for concentrating the flow of the anhydrous ammonia in a first direction (46) against a first enclosed end (50) of a first mixing chamber (48). A second mixing nozzle (48) concentrating the flow of anhydrous ammonia in a second direction (76) orthogonal to the first direction (46) and against a second enclosed end (80) of a second mixing chamber (78). A flow divider structure (96) is disposed about an outward end of the second mixing chamber (78) and has a plurality of flow ports (90) which are angularly spaced around and extend orthogonal to the second flow direction (76) through the second mixing nozzle (64).

20 Claims, 6 Drawing Sheets

ANHYDROUS AMMONIA FLOW DIVIDING MANIFOLD

TECHNICAL FIELD OF THE INVENTION

The present invention relates in general to ammonia fertilizer application systems for agricultural use, and in particular to an ammonia fertilizer spreader having flow dividers which mix a vapor and liquid ammonia into a homogeneous mixture prior to dividing and passing the ammonia to respective ground injector knives.

BACKGROUND OF THE INVENTION

Anhydrous ammonia $NH_3$ although first known as a refrigerant, is the lowest cost source of nitrogen for use as a fertilizer for fertilizing crops. Anhydrous ammonia $NH_3$ is made from natural gas and air, and is 82% nitrogen and 18% hydrogen by weight. Although anhydrous ammonia has a foul odor and is hazardous as an inhalant, it is a very popular fertilizer for use on row crops. For transport and storage, anhydrous ammonia is compressed so that it is a liquid at atmospheric temperatures. During application to fields for fertilizing row crops the anhydrous ammonia stored as liquid is expanded into a gas and injected into soil.

The typical electronically-controlled ammonia application system consists of a nurse tank trailed behind a tool bar which is attached to a tractor. A computer console is mounted accessible to the tractor operator. The typical mechanical ammonia application system is about the same as the electronic system, however it utilizes a manually-adjustable mechanical meter. The nurse tank is a trailer-mounted pressure vessel which contains the ammonia in its liquid state. A liquid withdrawal valve is mounted at the top of the tank and has a dip tube which extends to the bottom of the tank to withdraw the ammonia in liquid form. A suitable hose connects this valve to a filter connected to a main shutoff valve mounted on the tool bar. The ammonia then flows through a heat exchanger unit, then through a meter, then to an electronically controlled throttling valve, then to one or more dividing manifolds, and finally through suitable hoses to a applicator knives which inject the ammonia into the soil. As the liquid ammonia enters the dip tube located at the bottom of the tank and begins to flow, its thermodynamic conditions begin to change. The ammonia begins to expand. This results in the formation of ammonia vapor within the system which must be removed by a heat exchanger unit prior to metering in order to assure a properly-measured quantity of ammonia to the applicator knives and into the soil. These systems work fairly well, but under certain conditions problems can arise. The greater expansion of the ammonia across the total system often forms more vapor than the typical heat exchanger unit can handle.

Often various types of electronics including GPS are used to assure that fertilizers are spread evenly across a field. However, over the last sixty years of using anhydrous ammonia injecting into the ground of a field, the accuracy is usually the best up to 10% in so far as assuring that the anhydrous ammonia is equally distributed across the various rows in a field. Unequal distribution of anhydrous ammonia in a field may often be observed by comparing the height of adjacent rows of crops, which have been observed to vary as much as two feet.

The anhydrous ammonia is metered to apply selected amounts for different crops, such as corn requires more than twice the amount of ammonia per acre than the smaller grain crops. Problems often occur in metering ammonia since nitrogen expands in going from a liquid to a gas, often changing in volume in a ratio of one to eight hundred. Anhydrous ammonia is also a very good refrigerant and its temperatures are reduced as it expends from a liquid to gas. The metering problem is also exacerbated by the requirement of dividing the anhydrous nitrogen into equal flow streams to allow equal distribution of the nitrogen along the tool bars for a conventional row crop injection systems. The tool bars are typically seventy feet long and are pull behind a tractor, transverse to crop rows. The applicator knives are mounted to the tool bars for running about two inches into the ground and depositing nitrogen into the soil. The anhydrous nitrogen moving to the tool bar is a flowing mixture of decreasing liquid, and increasing and expanding vapor which requires dividing into equal amounts for passing to the various applicator knives spaced apart along the length of the tool bar. Dividing anhydrous nitrogen into equal flow streams is also made more difficult by the flow of the liquid and vapor phases separating into different slip stream flows, which is not a homogenous mixture.

SUMMARY OF THE INVENTION

A system for fertilizing soil with anhydrous ammonia has a nurse tank and metering device for providing a flow of the ammonia in liquid and vapor form to a flow dividing manifold. The dividing manifold divides the flow of anhydrous ammonia into equal flows distributed in separate flow paths. The dividing manifold has a first flow nozzle for accelerating and directing the flow of the anhydrous ammonia in a first direction against a first enclosed end of a first mixing chamber. An outward end of the first mixing chamber is in fluid communication with the a second flow nozzle. The second flow nozzle is configured for accelerating and directing the flow of the anhydrous ammonia in a second direction and into an enclosed end of a second mixing chamber. The first direction of flow through the first nozzle is preferably orthogonal to the second direction of flow through the second nozzle. A flow divider structure has a plurality of flow ports which are angularly spaced apart around an outward portion of the second mixing chamber, and the flow ports extend orthogonal to the second direction of flow through the second flow nozzle. The flow ports connect to respective one of applicator knives for injecting the anhydrous ammonia into the ground.

The first and second nozzles of the flow dividing manifold accelerate the mixed liquid and vapor flows into a mixing chamber having an enclosed end, accelerating the mixture into the enclosed end of the mixing chamber. The mixture flows back against an inlet flow within the first mixing chamber and then is passed through the second nozzle which accelerates the flow into the enclosed end of the second mixing chamber. The first and second nozzles accelerate the flow velocity of the inlet speed into respective ones of the nozzles, and the flow exits from each mixing chamber at ninety degrees to the direction of acceleration into respective ones of the mixing chambers. The flow exits the second mixing chamber as a homogeneous mixture which passes through flow ports equally spaced around an outer peripheral portion of the second mixing chamber and outward through metering orifices to hoses on a tool bar going to the various applicator knives. The applicator knives inject the massively expanding anhydrous ammonia into the various rows of crop, with very little liquid left, the anhydrous ammonia is expanded 400 to 800 times the size of volume initially in the tank. Ammonia is passed into the ground beneath the various rows in the field and absorbed by clay particles and bacteria.

DESCRIPTION OF THE DRAWINGS

For a more complete understanding of the present invention and the advantages thereof, reference is now made to the following description taken in conjunction with the accompanying Drawings in which

FIG. 1 is a top view of a tractor and a nitrogen injection unit;

FIG. 2 is partial top view of the tractor and the nitrogen injection unit;

FIG. 3 is a vertical section view a first ammonia dividing manifold having two mixing nozzles;

FIG. 4 is a section view of a flow divider, taken along section line 4-4 of FIG. 3;

FIG. 5 is vertical section view of a second ammonia dividing manifold having two internal mixing nozzles; and FIG. 6 is a section view of a flow divider, taken along section line 6-6 of FIG. 5.

DETAILED DESCRIPTION OF THE INVENTION

Figure 1:
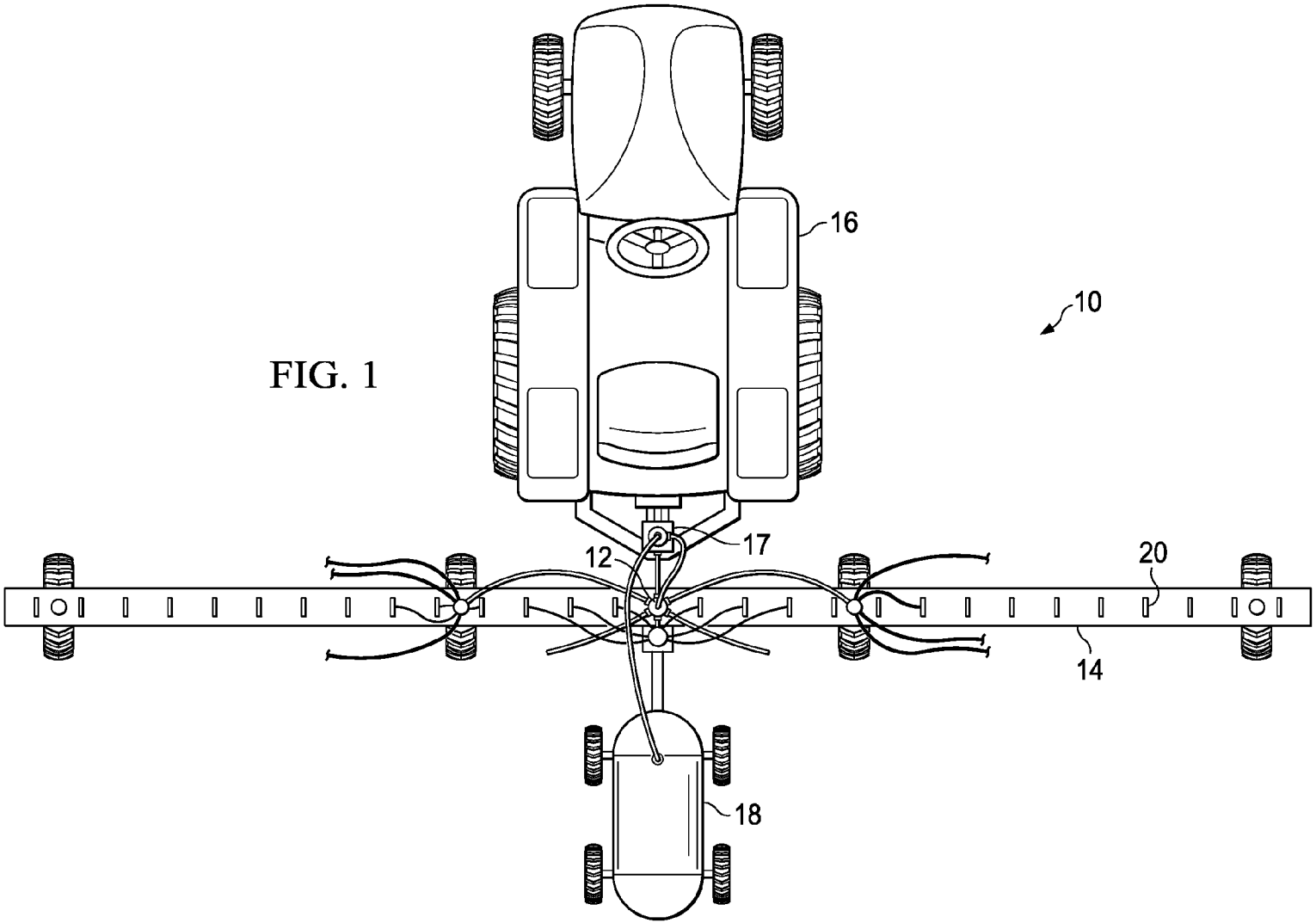
FIGS. 1 through 6 show various aspects for an ammonia flow divider made according to the present invention, with like numbers refer to like and corresponding parts, as set forth below.
Figure 2:
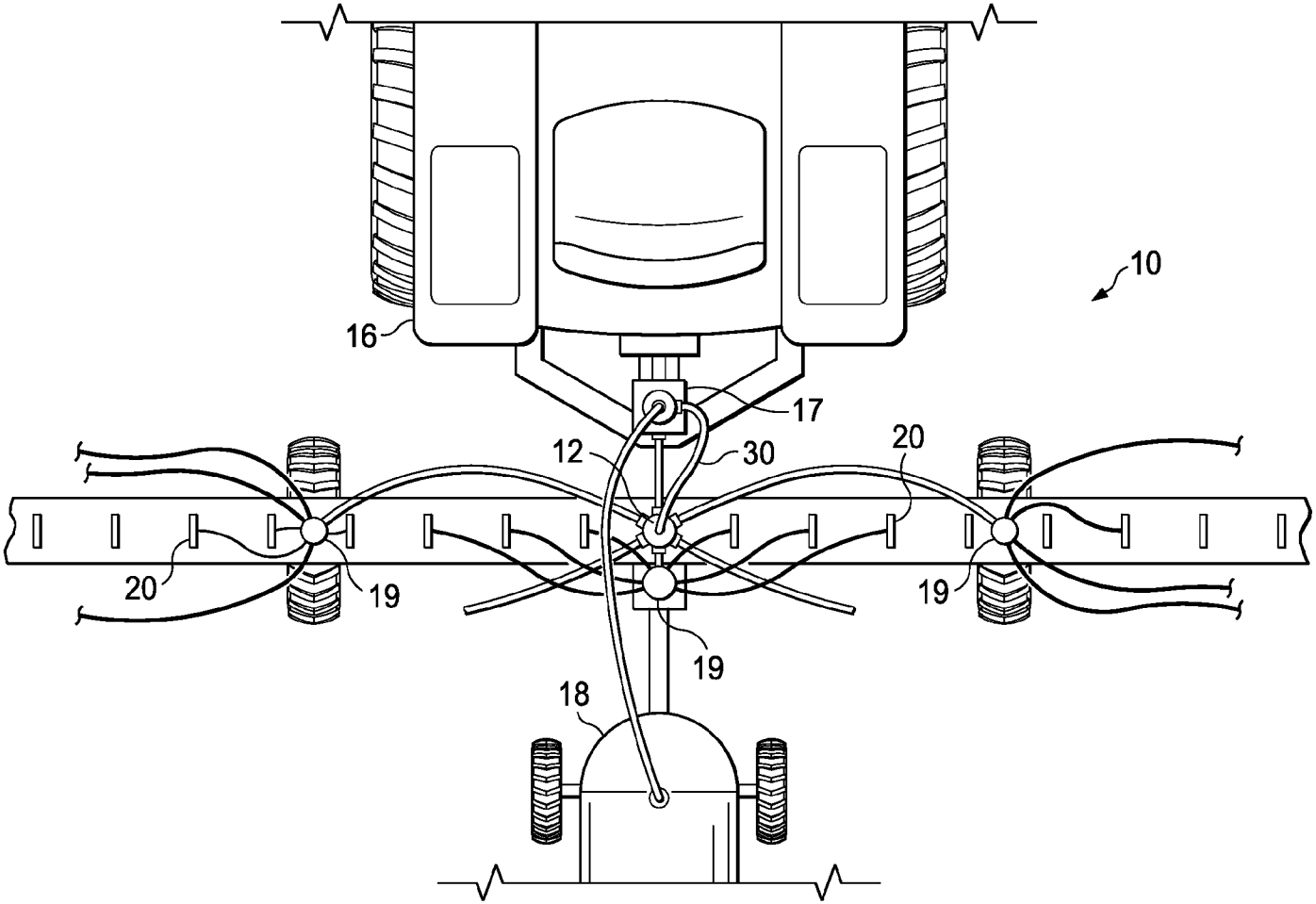

FIG. 1 is a top view and FIG. 2 is a partial top view of a tractor 16 and an ammonia distribution system 10. The ammonia distribution system 10 includes an ammonia manifold 12 mounted on tool bar 14. The tractor 16 pulls the tool bar 14 and the ammonia nurse tank 18 in conventional fashion. A meter 17 receives ammonia from the tank 18, then metered ammonia flows to ammonia dividing manifold 12, is divided, and then the divided flows are then further divided in sub-manifolds 19 connected to applicator knives 20 mounted on tool bar 14. The applicator knives 20 inject precisely-metered and accurately-divided streams of ammonia vapor into the soil as the tractor traverses an agricultural field.

The present invention is primarily focused on ammonia dividing manifolds 12 and 19, which are shown in detail in FIGS. 3-6. An inlet conduit 30 (FIG. 2) is connected between manifold 12 and a source of ammonia, which in this system is meter 17. Inlet conduit 30 is located downstream of the source of ammonia. The dividing manifold inlet 12 is located downstream of the inlet conduit 30 to receive a mixed stream of ammonia liquid and vapor from the source of ammonia by way of the inlet conduit 30.

Figure 3:
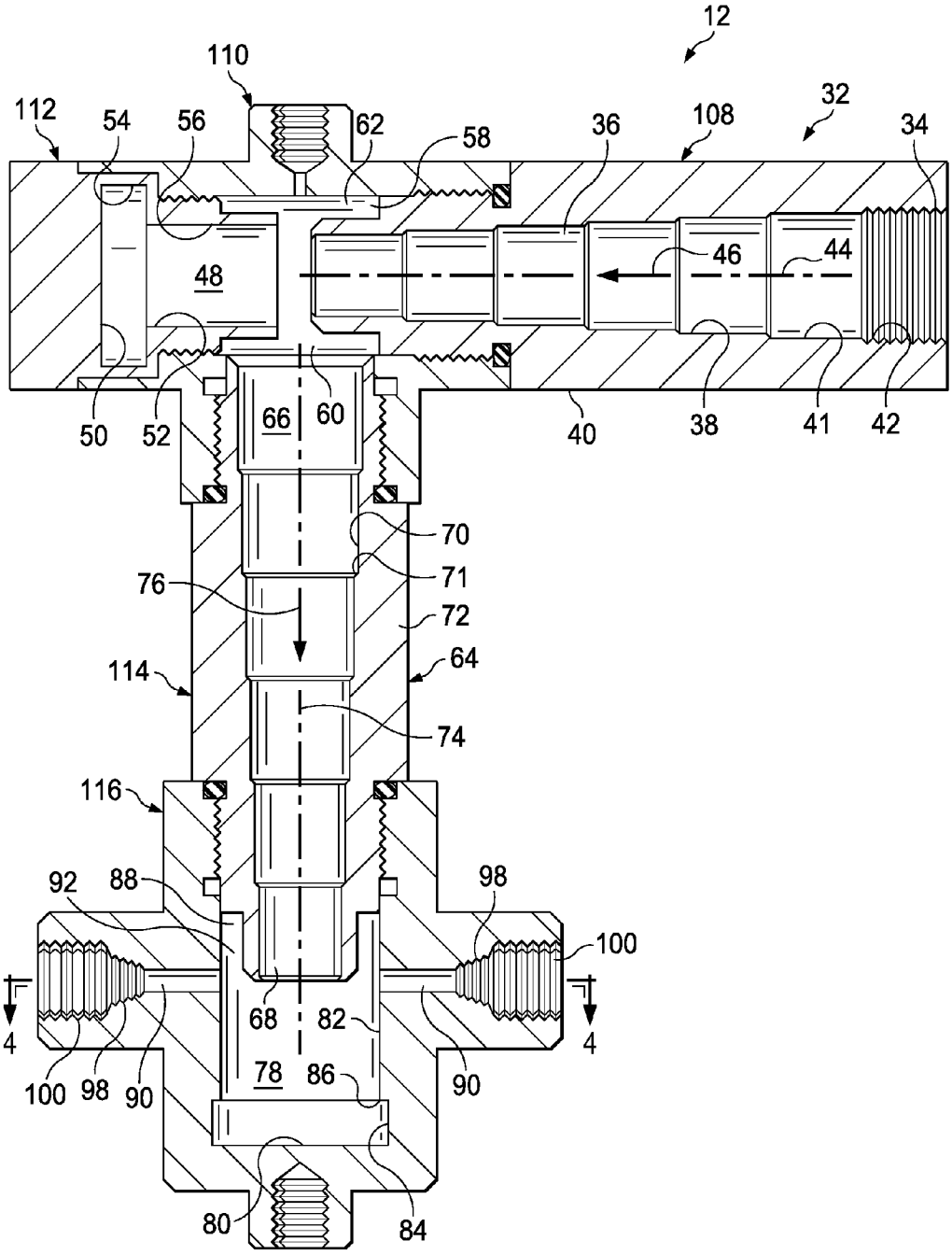

FIG. 3 is a vertical section view the first ammonia dividing manifold 12 having a first mixing nozzle 32, a first mixing chamber 48, a second mixing nozzle 64, a second mixing chamber 78, and a flow dividing structure 96 which are internally disposed within the manifold 12. The mixing nozzle 32 has an inlet 34, an outlet 36, and stepped wall walls 38 which are cylindrical and define nozzle sections 40. Adjoining wall portions 41 are disposed between the nozzle wall sections 40 and are preferably tapered at approximately a thirty degree angle to a longitudinal axis 44 for the mixing nozzle 32. The adjoining wall portions 41 force portions of the anhydrous ammonia flow through the nozzle 32 inward, concentrating the flow into a smaller cross-sectional area and mixing the vapor and liquid phases together. The walls 38 are preferably concentrically disposed about the longitudinal axis 44 for concentrating flow in a direction 46. The ratio of the cross-sectional area of the inlet 34 to the outlet 36 of the second mixing nozzle 32 is preferably such that the inlet 34 is larger than the outlet. An outermost wall is threaded to define a female fitting 42 for connecting the inlet 34 of the mixing nozzle 32 to a connector fitting of the inlet conduit 30.

A mixing chamber 48 defines a cup for receiving concentrated flow from the first mixing nozzle 34. The mixing chamber 48 has an end wall 50 which preferably defines a flat, planer enclosed end, a chamber side wall 52 which is preferably cylindrical, and an outer end 58. A recess 54 which is optional and preferably annular-shaped extends circumferentially into the side wall 52 adjacent the end wall 50. The recess 54 defines a protrusion 56 which is preferably annular shaped and extends circumferentially into the mixing chamber 48 to disrupt flow, changing the direction of flow rebounding from the end wall 50. The outer end 58 is preferably open, but enclosed by the first mixing nozzle 32 protruding into the mixing chamber 38. An annular-shaped space 62 extends around an inward end of the first mixing nozzle 32 to provide a flow path extending from the mixing chamber 48 to the flow port 60 and an inlet 66 of the second mixing nozzle 64. A gap of preferably one-quarter to three-quarter inches extends between the terminal end of the first mixing nozzle 32 at the outlet 36 and the terminal end of the sidewall 52 of the mixing chamber 48.

In principal, the first mixing nozzle 32 concentrates flow of anhydrous ammonia liquid and vapor into the mixing chamber 48 which acts as an enclosed cup, which then flows back across the cup mixing the vapor and liquid together and changing the directions of flow to stop the momentum of the flowing fluids. The discharge from the first mixing nozzle 32 is focused such that it is concentrated perpendicular to and directly against the end wall 50. The anhydrous ammonia liquid and vapor rebounding from the impact with the end wall 50 will flow exteriorly about the discharge from the first mixing nozzle 32, a portion of which flows into the recess 54 which with the protrusion 56 channels flow back toward a central portion of the mixing chamber 48 through which the discharge from the first mixing nozzle 32 is flowing. The anhydrous ammonia will flow back to the open space 62 and through the flow port 60 into the second mixing nozzle 62.

The mixing nozzle 64 has an inlet 66 and an outlet 68, and stepped wall walls 70 which are cylindrical and define nozzle sections 72. The flow port 60 from the first mixing chamber 48 preferably provide the second mixing nozzle inlet 66. Adjoining wall portions 71 between the nozzle sections 72 are preferably tapered at approximately a thirty degree angle to a longitudinal axis 74 for the mixing nozzle 64. The adjoining wall portions 71 force portions of the anhydrous ammonia flow through the nozzle 32 inward, concentrating the flow into a smaller cross-sectional area and mixing the vapor and liquid phases together. The walls 70 are preferably concentrically disposed about the longitudinal axis 74 for concentrating flow in a flow direction 76. The ratio of the cross-sectional area of the inlet 66 to the outlet 68 of the second mixing nozzle 64 is preferably that such that the inlet 66 is larger then the outlet 68.

A second mixing chamber 78 defines a cup for receiving concentrated flow from the first mixing nozzle 64. The mixing chamber 68 has an end wall 80 which preferably defines a flat, planer enclosed end, a chamber side wall 82 which is preferably cylindrical, and an outer end 88. A recess 84 which is optional and preferably annular-shaped and circumferentially extends into the side wall 82 adjacent the end wall 80. The recess 84 defines a protrusion 86 which is preferably annular shaped and circumferentially extends into the mixing chamber 88 to disrupt flow, changing the direction of flow rebounding from the end wall 80. The outer end 88 is preferably open, but enclosed by the first mixing nozzle 82 protruding into the mixing chamber 78. An annular-shaped space 92 extends around an inward end of the second mixing nozzle 64 to provide a flow path extending from the mixing chamber 78 to the flow ports 90 and the flow divider 96 and the second mixing nozzle 64.

Similar to the first mixing nozzle 32, the second mixing nozzle 64 concentrates flow of anhydrous ammonia liquid and vapor into the mixing chamber 78 which acts as an enclosed cup. The ammonia flows through the nozzle 64 and is accelerated preferably to a greater speed than the entry speed into the nozzle 64, and focused to concentrate the ammonia flow on a central portion of the end wall 80, which is preferably an enclosed, planar surface located perpendicular to the flow direction 76 of the ammonia through the nozzle 64. The ammonia flow will rebound off the end wall 50 mixing the vapor and liquid together and changing the directions of flow to stop the momentum of the flowing fluids. The anhydrous ammonia liquid and vapor rebounding from the impact with the end wall 80 will flow exteriorly about the discharge from the first mixing nozzle 64, a portion of which flows into the recess 84 which with the protrusion 86 channels flow back toward a central portion of the mixing chamber 88 through which the discharge from the first mixing nozzle 64 is flowing. The anhydrous ammonia will flow back to the open space 92 and through the flow ports 90 of the flow divider 96.

Figure 4:
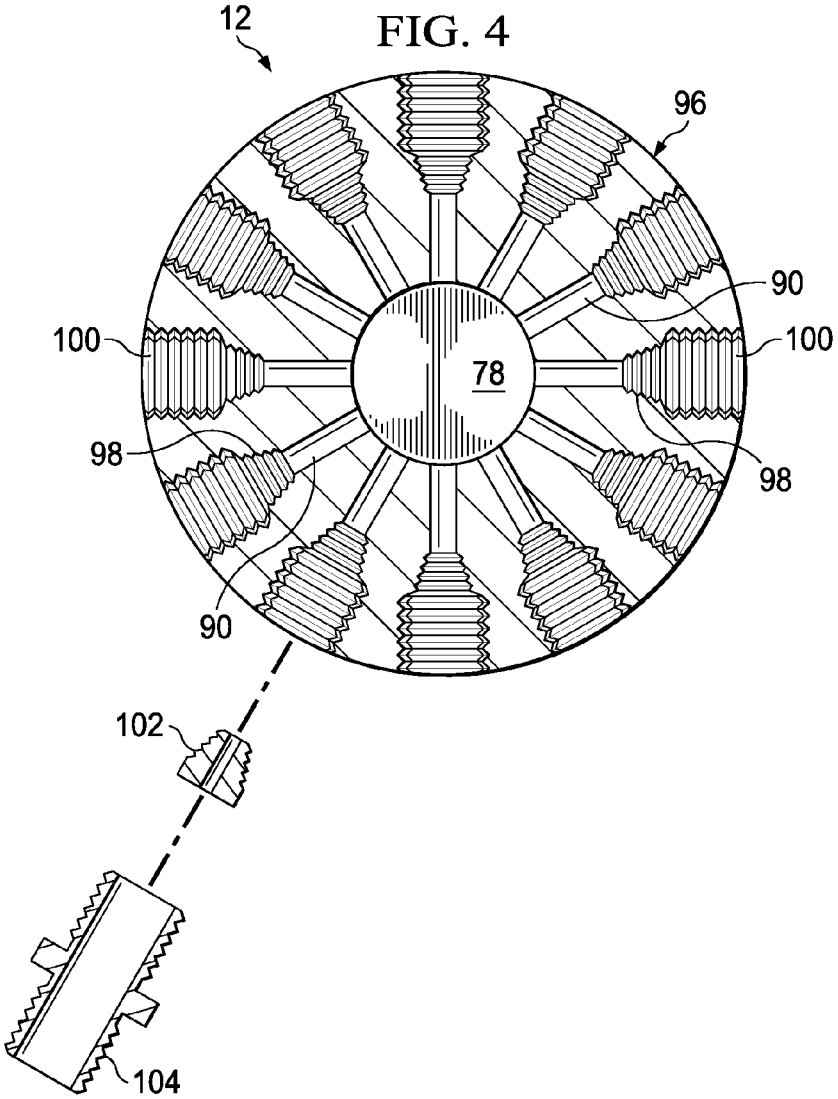

FIG. 4 is a section view of a flow divider 96 taken along section line 4-4 of FIG. 3. The flow divider has a plurality of flow ports 90 which are preferably spaced apart equal angular distances about the longitudinal axis 74 of the second mixing nozzle 64. Outward ends of the flow ports 90 have a first threaded section 98 for receiving an orifice fittings 102, and a second threaded section 100 for receiving hose barb fittings 104. Conduits may be connected from the hose barb fittings 104 for extending to respective ones of the secondary flow dividing manifolds 19. In some alternate applications, the conduits may be connected directly to the injection knives 20. (Not shown). The anhydrous ammonia will preferably pass through the various flow ports 90 as a homogenous mixture of vapor and liquid, divided into substantially equal parts for each of the respective flow ports 90 being used.

The first flow dividing manifold 12 is preferably formed as five machines parts as shown in FIG. 3, with O-ring seals sealingly engaging between respective ones of the machines parts. The five machined parts shown are a first nozzle section 108, a T-fitting, an end plug 112, a second nozzle section 114 and a flow divider section 116. The first nozzle section 108 is preferably drilled such that an interior profile defines the stepped walls 38 and the adjoining portions 41 of the first mixing nozzle 32. The T-fitting 110 preferably threadlingly receives an outlet portion the first nozzle section 108 in one end, the end plug 112 in a second end, and an inlet portion of the second nozzle section 114 in a third end. The end plug 112 or the second end of the T-fitting 110 may be machined to define the annular-shaped recess 54. The flow divider section 116 is preferably machined form a single block of material and is threadingly secured to the discharge end of the second nozzle section 114.

Figure 5:
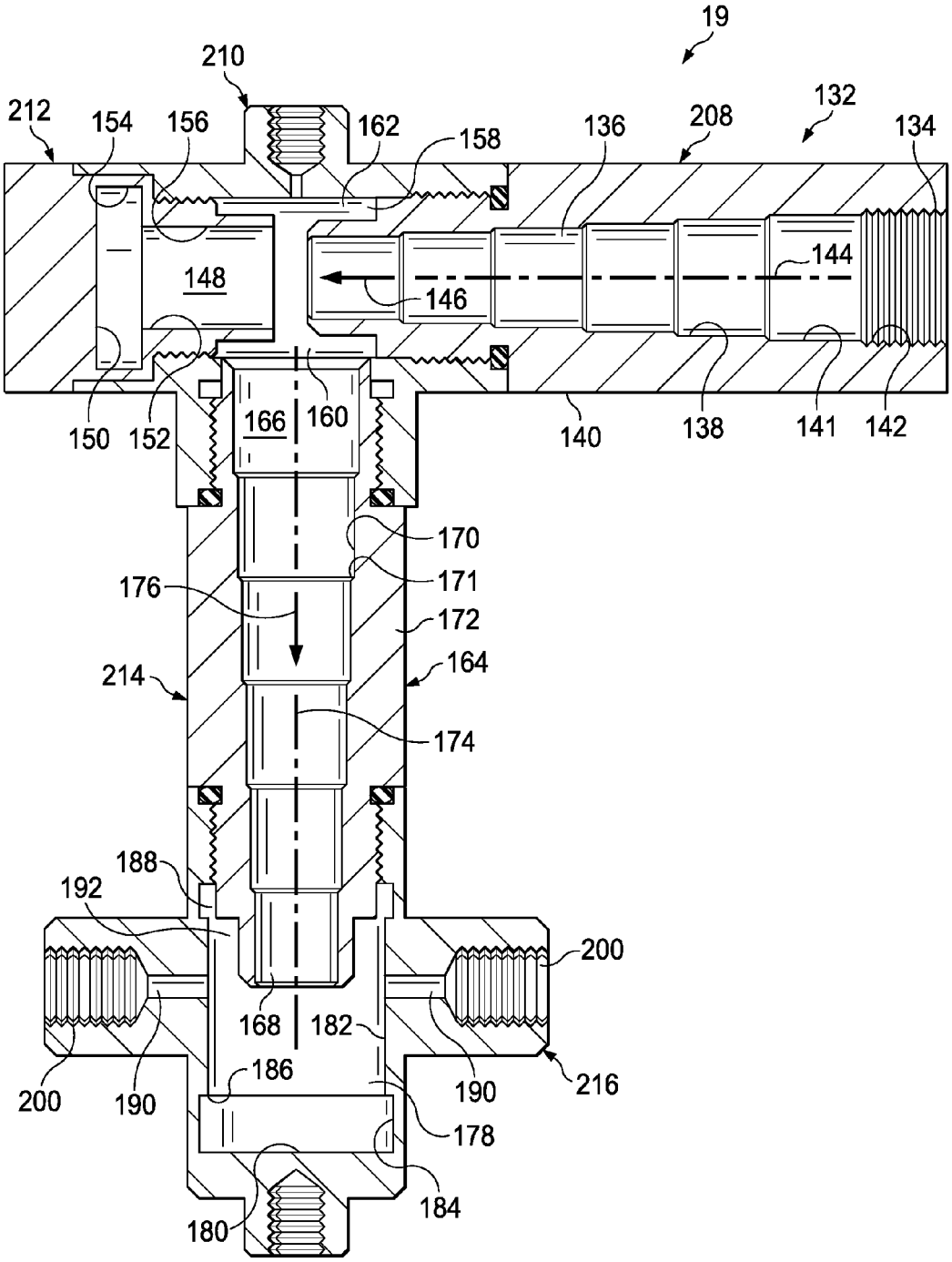

FIG. 5 is a vertical section view the first ammonia dividing manifold 19 having a first mixing nozzle 132, a first mixing chamber 128, a second mixing nozzle 164, a second mixing chamber 178, and a flow dividing structure 196 which are internally disposed within the manifold 19. The mixing nozzle 132 has an inlet 134, an outlet 136, and stepped wall walls 138 which are cylindrical and define nozzle sections 140. Adjoining wall portions 141 are disposed between the nozzle wall sections 140 and are preferably tapered at approximately a thirty degree angle to a longitudinal axis 144 for the mixing nozzle 132. The adjoining wall portions 41 force portions of the anhydrous ammonia flow through the nozzle 132 inward, concentrating the flow into a smaller cross-sectional area and mixing the vapor and liquid phases together. The walls 138 are preferably concentrically disposed about the longitudinal axis 44 for concentrating flow in a direction 46. The ratio of the cross-sectional area of the inlet 134 to the outlet 136 of the second mixing nozzle 32 is preferably that such that the inlet 134 is larger than the outlet 136. An outermost wall is threaded to define a female fitting 142 for connecting the inlet 134 of the mixing nozzle 132 to a connector fitting of an inlet conduit.

A mixing chamber 148 defines a cup for receiving concentrated flow from the first mixing nozzle 134. The mixing chamber 148 has an end wall 150 which preferably defines a flat, planer enclosed end, a chamber side wall 152 which is preferably cylindrical, and an outer end 158. A recess 154 which is optional and preferably annular-shaped extends circumferentially into the side wall 152 adjacent the end wall 150. The recess 154 defines a protrusion 156 which is preferably annular shaped and extends circumferentially into the mixing chamber 148 to disrupt flow, changing the direction of flow rebounding from the end wall 150. The outer end 158 is preferably open, but enclosed by the first mixing nozzle 132 protruding into the mixing chamber 138. An annular-shaped space 162 extends around an inward end of the first mixing nozzle 132 to provide a flow path extending from the mixing chamber 148 to the flow port 160 and the second mixing nozzle 164. A gap of preferably one-quarter to three-quarter inches extends between the terminal end of the first mixing nozzle 132 at the outlet 136 and the terminal end of the sidewall 152 of the mixing chamber 148.

In principal, the first mixing nozzle 132 concentrates flow of anhydrous ammonia liquid and vapor into the mixing chamber 148 which acts as an enclosed cup, which then flows back across the cup mixing the vapor and liquid together and changing the directions of flow to stop the momentum of the flowing fluids. The discharge from the first mixing nozzle 132 is focused such that it is concentrated perpendicular to and directly against the end wall 150. The anhydrous ammonia liquid and vapor rebounding from the impact with the end wall 150 will flow exteriorly about the discharge from the first mixing nozzle 132, a portion of which flows into the recess 154 which with the protrusion 156 channels flow back toward a central portion of the mixing chamber 148 through which the discharge from the first mixing nozzle 132 is flowing. The anhydrous ammonia will flow back to the open space 162 and through the flow port 160 into the second mixing nozzle 162.

The mixing nozzle 164 has an inlet 166 and an outlet 168, and stepped wall walls 170 which are cylindrical and define nozzle sections 172. The flow port 160 from the first mixing chamber 148 preferably provide the second mixing nozzle inlet 166. Adjoining wall portions 171 between the nozzle sections 172 are preferably tapered at approximately a thirty degree angle to a longitudinal axis 174 for the mixing nozzle 164. The adjoining wall portions 171 force portions of the anhydrous ammonia flow through the nozzle 132 inward, concentrating the flow into a smaller cross-sectional area and mixing the vapor and liquid phases together. The walls 170 are preferably concentrically disposed about the longitudinal axis 174 for concentrating flow in a flow direction 176. The ratio of the cross-sectional area of the inlet 166 to the outlet 168 of the second mixing nozzle 164 is preferably such than the inlet 166 is larger than the outlet 168.

A second mixing chamber 178 defines a cup for receiving concentrated flow from the first mixing nozzle 164. The mixing chamber 68 has an end wall 180 which preferably defines a flat, planer enclosed end, a chamber side wall 182 which is preferably cylindrical, and an outer end 188. A recess 184 which is optional and preferably annular-shaped and circumferentially extends into the side wall 182 adjacent the end wall 180. The recess 184 defines a protrusion 186 which is preferably annular shaped and circumferentially extends into the mixing chamber 188 to disrupt flow, changing the direction of flow rebounding from the end wall 180. The outer end 188 is preferably open, but enclosed by the first mixing nozzle 182 protruding into the mixing chamber 178. An annular-shaped space 192 extends around an inward end of the second mixing nozzle 64 to provide a flow path extending from the mixing chamber 178 to the flow ports 190 and the flow divider 196 and the second mixing nozzle 164.

Similar to the first mixing nozzle 132, the second mixing nozzle 164 concentrates flow of anhydrous ammonia liquid and vapor into the mixing chamber 178 which acts as an enclosed cup. The ammonia flows through the nozzle 164 and is accelerated as It flows through into the nozzle 164, and focused to concentrate the ammonia flow on a central portion of the end wall 180, which is preferably an enclosed, planar surface located perpendicular to the flow direction 176 of the ammonia through the nozzle 164. The ammonia flow will rebound off the end wall 150 mixing the vapor and liquid together and changing the directions of flow to stop the momentum of the flowing fluids. The anhydrous ammonia liquid and vapor rebounding from the impact with the end wall 180 will flow exteriorly about the discharge from the first mixing nozzle 164, a portion of which flows into the recess 184 which with the protrusion 186 channels flow back toward a central portion of the mixing chamber 188 through which the discharge from the first mixing nozzle 164 is flowing. The anhydrous ammonia will flow back to the open space 192 and through the flow ports 190 of the flow divider 196.

Figure 6:
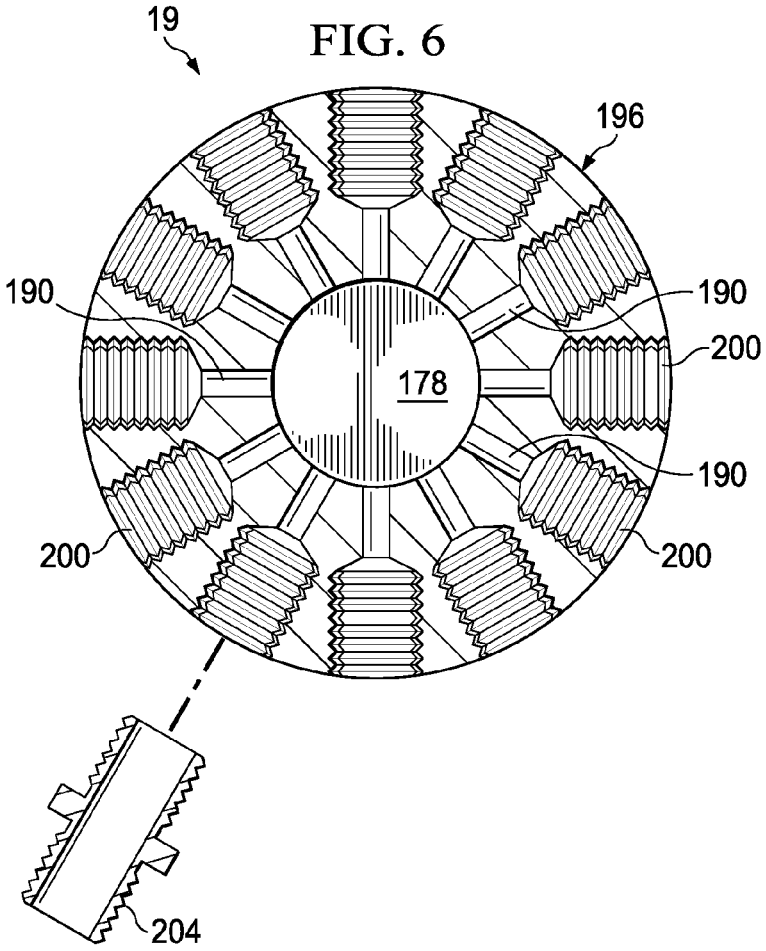

FIG. 6 is a section view of a flow divider 96 taken along section line 6-6 of FIG. 5. The flow divider has a plurality of flow ports 190 which are preferably spaced apart equal angular distances about the longitudinal axis 174 of the second mixing nozzle 164. Outward ends of the flow ports 190 have a threaded section 200 for receiving hose barb fittings 204. Conduits are connected from the hose barb fittings 204 for connecting directly to the injection knives 20. (Shown in FIG. 2). The hose barb fittings 204 may have interior ports which define orifices of selected size for determining flow rates through the fittings 204. The anhydrous ammonia will preferably pass through the various flow ports 190 as a homogenous mixture of vapor and liquid, divided into substantially equal parts for each of the respective flow ports 190 being used.

The second flow dividing manifold 19 is preferably formed as five machines parts as shown in FIG. 3, with O-ring seals sealingly engaging between respective ones of the machines parts. The five machined parts shown are a first nozzle section 208, a T-fitting, an end plug 212, a second nozzle section 214 and a flow divider section 216. The first nozzle section 208 is preferably drilled such that an interior profile defines the stepped walls 138 and the adjoining portions 141 of the first mixing nozzle 132. The T-fitting 210 preferably threadlingly receives an outlet portion the first nozzle section 208 in one end, the end plug 212 in a second end, and an inlet portion of the second nozzle section 214 in a third end. The end plug 212 or the second end of the T-fitting 210 may be machined to define the annular-shaped recess 154. The flow divider section 216 is preferably machined form a single block of material and is threadingly secured to the discharge end of the second nozzle section 214.

The present invention provides advantages of a nozzle cross-sectional area reduced 2.5 to 1 (flow velocity increase) into a mixing chamber defined by a cup-shaped element defining a blind hole—with an annular-shaped space adjacent an end face of the cup-shaped element. For ammonia, the liquid phased tends to flow along the flowpath walls and the vapor phase tends to flow along the central portion of the flowpath, away from the walls. The flow from the nozzle entering the central region of the mixing chamber occupies the central region, forcing both phases of the rebound flow outward and along the mixing chamber walls, enhancing mixing. That is, inward flow into center of mixing chamber from the nozzle forces all flow along walls of mixing chamber, rather than allowing liquid to flow along walls with vapor phase in central portion of the mixing chamber. The discontinuity in the mixing chamber wall provided by the annular space increases turbulence and thus mixing. Further, rebounding the flow off the end face of the mixing chamber—to reverse the flow—aids in removing momentum from the fluid flow which would have resulted in the liquid phase flowing to one side of the divider, providing more liquid ammonia than vapor phase ammonia to that particular side, resulting in a non-homogeneous mixture distribution from the flow divider mechanism. The homogeneous mixture of anhydrous ammonia flows through various orifices connecting to separate ground injection knives. Tests have shown that the present invention provides results of approximately 2½% variations in distribution to each knife.

Although the preferred embodiment has been described in detail, it should be understood that various changes, substitutions and alterations can be made therein without departing from the spirit and scope of the invention as defined by the appended claims.

What is claimed is:

1. A fluid flow dividing manifold for dividing a flow of fluid having both liquid and gas phases, comprising:

a first flow nozzle having a first inlet and a first outlet, said inlet connected to a supply of said fluid and said first outlet disposed for directing flow of said fluid in liquid and gaseous form in a first direction, from said first flow nozzle into a first mixing chamber;

said first mixing chamber having a first sidewall, a first open end and a first closed end, said first sidewall extending adjacent to said first closed end, and wherein said first open end extends in opposed relation to said first outlet, with said first closed end spaced apart from said first outlet for engaging said flow of fluid discharged from said first outlet;

a second flow nozzle having a second inlet and a second outlet, said second flow nozzle aligned in orthogonal relation to said first flow nozzle for directing said fluid to flow in a second direction which is transverse to said first direction, and from said second flow nozzle into a second mixing chamber;

said second mixing chamber having a second sidewall, a second open end and a second closed end, said second sidewall extending adjacent to said second closed end, wherein said second open end extends in opposed relation to said second outlet, with said second closed end spaced apart from said second outlet for engaging said flow of fluid discharged from said second outlet; and a flow divider structure disposed about said second mixing chamber, said flow divider having a plurality of flow ports for passing said fluid from said second mixing chamber into a plurality of flow passages.

2. The fluid flow dividing manifold of claim 1, wherein said fluid is anhydrous ammonia.

3. The fluid flow dividing manifold of claim 2, wherein said first flow nozzle has a first inlet cross-sectional area which of a larger size than a first size of a first outlet cross-sectional area.

4. The fluid flow dividing manifold of claim 3, wherein said second flow nozzle has a second inlet cross-sectional area which is larger in size than a second size of a second outlet cross-sectional area.

5. The fluid flow dividing manifold of claim 1, wherein a first recesses extends into said first sidewall, continuously around said first sidewall and adjacent to said first closed end.

6. The fluid flow dividing manifold of claim 1, wherein a second recess extends into said second sidewall and extends continuously around said second sidewall and adjacent to said second closed end.

7. The fluid flow dividing manifold of claim 1, wherein said ports of said flow divider structure extends transversely through said second sidewall, disposed orthogonal to said second direction which said fluid flows through said second flow nozzle.

8. The fluid flow dividing manifold of claim 7, wherein said ports extend around said second outlet of said second nozzle, angularly spaced apart about said second flow nozzle.

9. A fluid flow dividing manifold for dividing a flow of fluid having both liquid and gas phases, comprising:

a first flow nozzle having a first inlet and a first outlet, said inlet connected to a supply of said fluid and said first outlet disposed for directing flow of said fluid in liquid and gaseous form in a first direction, from said first flow nozzle into a first mixing chamber;

said first mixing chamber having a first sidewall, a first open end and a first closed end, said first sidewall having a first recess formed therein, said recess extending continuously around said first sidewall and adjacent to said first closed end, and wherein said first open end extends in opposed relation to said first outlet, with said first closed end spaced apart from said first outlet for engaging said flow of fluid discharged from said first outlet;

a second flow nozzle having a second inlet and a second outlet, said second flow nozzle aligned in orthogonal relation to said first flow nozzle for directing said fluid to flow in a second direction which is orthogonal to said first direction, and from said second flow nozzle into a second mixing chamber;

said second mixing chamber having a second sidewall, a second open end and a second closed end, said second sidewall having a second recess formed therein said recess extending continuously around said second sidewall and adjacent to said second closed end, wherein said second open end extends in opposed relation to said second outlet, with said second closed end spaced apart from said second outlet for engaging said flow of fluid discharged from said second outlet; and a flow divider structure disposed about said second mixing chamber, said flow divider having a plurality of flow ports extending transversely through said second sidewall for passing said fluid from said second mixing chamber into a plurality of flow passages.

10. The fluid flow dividing manifold of claim 9, wherein said fluid is anhydrous ammonia.

11. The fluid flow dividing manifold of claim 10, wherein said first flow nozzle has a first inlet cross-sectional area which is of a larger size than a first size of a first outlet cross-sectional area.

12. The fluid flow dividing manifold of claim 10, wherein said second flow nozzle has a second inlet cross-sectional area which is of a larger size than a second size of a second outlet cross-sectional area.

13. The fluid flow dividing manifold of claim 9, wherein said ports extend around said second outlet of said second nozzle, angularly spaced apart about said second flow nozzle.

14. The fluid flow dividing manifold of claim 12, wherein said flow pots of said flow divider extend orthogonal to said second direction which said fluid flows through said second flow nozzle.

15. A fluid flow dividing manifold for dividing a flow of anhydrous ammonia having both liquid and gas phases, comprising:

a first flow nozzle having a first inlet and a first outlet, said inlet connected to a supply of said anhydrous ammonia and said first outlet disposed for directing flow of said anhydrous ammonia in liquid and gaseous form in a first direction, from said first flow nozzle into a first mixing chamber;

said first mixing chamber having a first sidewall, a first open end and a first closed end, said first sidewall having a first recess formed therein, said recess extending continuously around said first sidewall and adjacent to said first closed end, and wherein said first open end extends in opposed relation to said first outlet, with said first closed end spaced apart from said first outlet for engaging said flow of anhydrous ammonia discharged from said first outlet;

a second flow nozzle having a second inlet and a second outlet, said second flow nozzle aligned in orthogonal relation to said first flow nozzle for directing said anhydrous ammonia to flow in a second direction which is orthogonal to said first direction, and from said second flow nozzle into a second mixing chamber;

said second mixing chamber having a second sidewall, a second open end and a second closed end, said second sidewall having a second recess formed therein said recess extending continuously around said second sidewall and adjacent to said second closed end, wherein said second open end extends in opposed relation to said second outlet, with said second closed end spaced apart from said second outlet for engaging said flow of anhydrous ammonia discharged from said second outlet; and a flow divider structure disposed about said second mixing chamber, said flow divider having a plurality of flow ports extending transversely through said second sidewall for passing said anhydrous ammonia from said second mixing chamber into a plurality of flow passages, wherein said flow ports extend around said second outlet of said second nozzle, angularly spaced apart about said second flow nozzle and orthogonal to said second direction of flow.

16. The fluid flow dividing manifold of claim 15, wherein said first flow nozzle has a first inlet cross-sectional area which is of a larger size than a size of a first outlet cross-sectional area.

17. The fluid flow dividing manifold of claim 16 wherein said second flow nozzle has a second inlet cross-sectional area which is of larger second size than a second size of a second outlet cross-sectional area.

18. The fluid flow dividing manifold of claim 15, wherein said first nozzle and said second nozzle provide a series of reduced diameters to step the interiors of the first and second nozzles to smaller cross-sectional areas and accelerate the flow of the anhydrous ammonia through said first nozzle and said second nozzle.

19. The fluid flow dividing manifold of claim 18, wherein said first and second nozzles, and said first and second mixing chambers are cylindrical in shape.

20. The fluid flow dividing manifold according to claim 19, wherein said first and second recesses are annular-shaped and extend continuously around said first and second sidewalls of said first and second mixing chambers.

* * * * *